United States Patent [19]

Adams et al.

[11] Patent Number: 4,617,951

[45] Date of Patent: Oct. 21, 1986

[54] WEAPON CONCEALMENT AND LOCKING MEANS

[75] Inventors: William C. Adams, Lithonia; William J. Taylor, Decatur, both of Ga.

[73] Assignee: Atlanta Cutlery Corporation, Conyers, Ga.

[21] Appl. No.: 764,387

[22] Filed: Aug. 12, 1985

[51] Int. Cl.[4] ..... A45B 3/14; A45B 9/02; A45B 23/00

[52] U.S. Cl. ..... 135/66; 135/16; 135/76; 403/322

[58] Field of Search ..... 135/16, 66, 76; 273/84 R; 30/151, 337, 338; 403/322; 42/52, 53

[56] References Cited

U.S. PATENT DOCUMENTS

| | | | |
|---|---|---|---|
| 880,047 | 2/1908 | Smith | 135/66 |
| 1,509,157 | 9/1924 | Leano | 135/66 |
| 2,266,606 | 12/1941 | Jones | 273/84 R |
| 3,707,794 | 1/1973 | Rocha et al. | 42/52 X |
| 4,037,839 | 7/1977 | Nelson | 273/84 R |
| 4,453,449 | 6/1984 | Hollmann | 403/322 X |

FOREIGN PATENT DOCUMENTS

| | | | |
|---|---|---|---|
| 2432155 | 3/1980 | France | 135/66 |
| 526759 | 5/1955 | Italy | 135/76 |
| 158482 | 2/1921 | United Kingdom | 135/66 |
| 783490 | 11/1980 | U.S.S.R. | 403/322 |

*Primary Examiner*—Robert E. Bagwill
*Assistant Examiner*—Terrence L. B. Brown
*Attorney, Agent, or Firm*—Rodgers & Rodgers

[57] ABSTRACT

Device for concealing and locking in place a weapon such as in conjunction with an umbrella wherein the weapon can be unlocked and withdrawn at will. The weapon locking device is operated by manually releasing spring-biased locking pins which are frictionally interlocked with a portion of the weapon when it is disposed in its locked position.

8 Claims, 6 Drawing Figures

WEAPON CONCEALMENT AND LOCKING MEANS

TECHNICAL FIELD

This invention relates to means for concealing weapons in everyday items such as umbrellas and the like and securely locking the weapons in place whereby they cannot be accidentally withdrawn.

BACKGROUND ART

Various means for concealing weapons are known such as are disclosed in the following U.S. Pat. Nos.: 16,761, 146,054, 723,260, 857,047, 1,283,015, 1,474,292.

DISCLOSURE OF THE INVENTION

By this invention, weapon concealment and locking means is provided and comprises an elongated tube, a ferrule affixed to one end of the tube, the ferrule comprising locking means, locking means associated with the weapon, and the locking means associated with the weapon being adapted to cooperate with the locking means associated with the ferrule.

BEST MODE OF CARRYING OUT THE INVENTION

Figure 1:
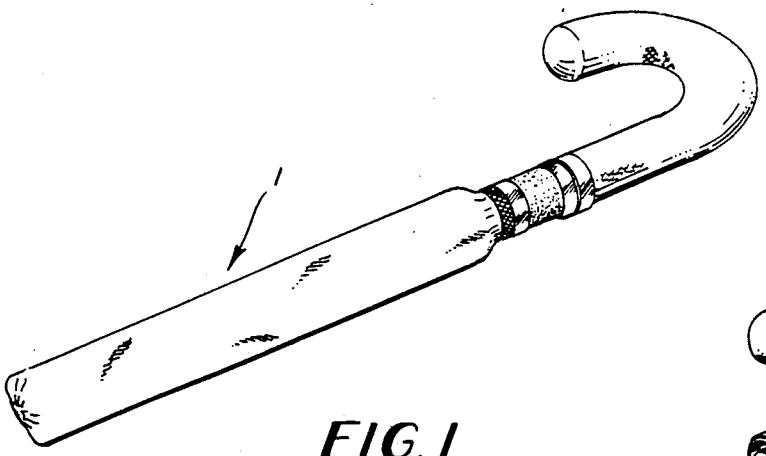
FIG. 1 is a perspective view of the weapon concealment and locking means constructed according to this invention in association with an umbrella.

In the drawings, the numeral 1 generally identifies a conventional umbrella. Weapon 2 is integrally secured at one end thereof to handle 3 of umbrella 1. Of course, the weapon shown in the drawings is in the form of a dagger but can also take the form of various other types of weapons such as knives, swords, guns and the like.

Figure 3:
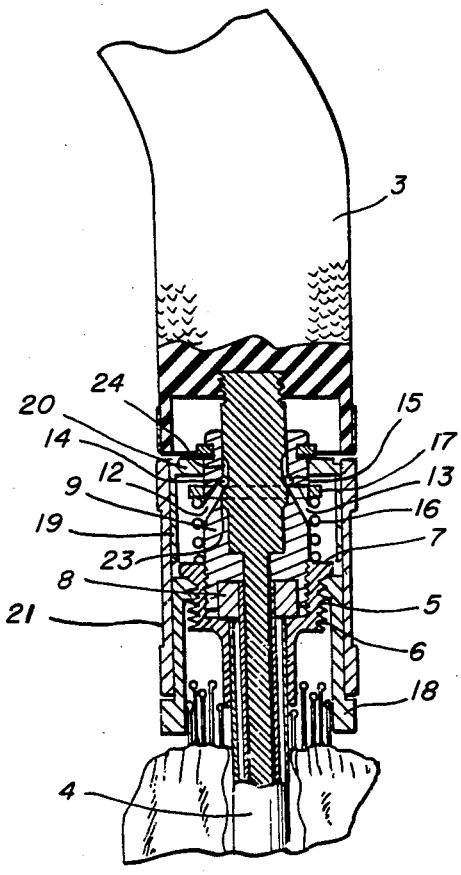
FIG. 3 is an exploded cross-sectional view through the center of a portion of the umbrella.
Figures 4, 5, 6:
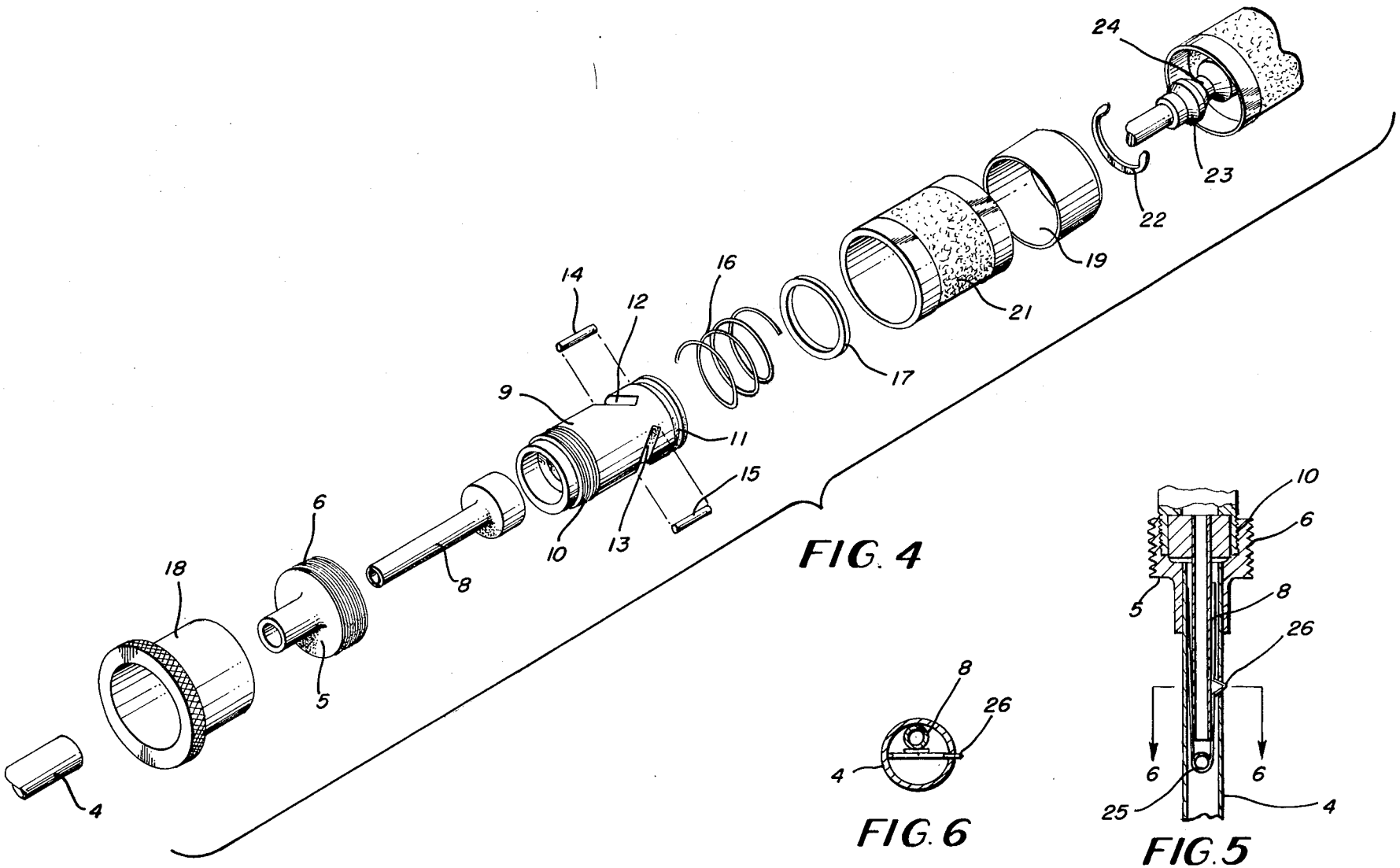
FIG. 4 is an enlarged exploded view of the elements essentially shown in FIG. 3.
FIG. 5 is an enlarged cross-sectional view of the umbrella spring catch and associated structure.
FIG. 6 is a cross-sectional view taken along the line 6—6 in FIG. 5.

With particular reference to FIGS. 3 and 4, the conventional elongated center tube of umbrella 1 is indicated by the numeral 4. A ferrule, which is of composite construction, is suitably secured on one end of elongated tube 4. More specifically, the ferrule is hollow interiorly and comprises cap 5. In addition, cap 5 is provided with threaded outer portion 6 and abutment surface 7. The ferrule further comprises guide 8 and locking sleeve 9. Locking sleeve 9 is provided with threaded portion 10 and snap ring receiving slot 11.

In accordance with this invention, pin receiving slots 12 and 13 are formed in locking sleeve 9. Pin receiving slots 12 and 13 are disposed generally on opposite sides of locking sleeve 9 and are adapted to receive pins 14 and 15, respectively. Also, pin receiving slots 12 and 13 are, in effect, cut deeply enough into locking sleeve 9 so as to allow portions of pins 14 and 15 to be disposed within the interior of locking sleeve 9 as shown in FIG. 3.

Compression spring 16 is adapted to slip over locking sleeve 9 and, at one end thereof, to form an abutting relationship with abutment surface 7, as best shown in FIG. 3. Washer 17 is adapted for ultimate disposition in abutting relationship with the opposite end of spring 16.

In order to assemble the umbrella and weapon combination in a locked disposition according to this invention, first of all, securing sleeve 18 is slipped over elongated tube 4. Then with spring 16 compressed between abutment surface 7 and washer 17 and with washer 17 disposed below pin receiving slots 12 and 13, pins 14 and 15 are placed in pin receiving slots 12 and 13, respectively. The ends of pins 14 and 15 are then disposed in abutment with the upper surface of washer 17 as viewed in FIG. 3. Therefore, the action of spring 16 tends to urge pins 14 and 15 fully into pin receiving slots 12 and 13, respectively, especially since pin receiving slots 12 and 13 are disposed at an acute angle with respect to to elongated tube 4. Although pins 14 and 15 are shown in the drawing, other locking means such as ball bearings could also be utilized.

Following this operation, cap 5 is maneuvered into frictional engagement with the upper end of elongated tube 4 as is best shown in FIG. 3. Guide 8 is then inserted on top of cap 5 and into the inner portion of elongated tube 4, and locking sleeve 9 and associated structure discussed above is screwed into the threaded inner portion of cap 5 by means of threaded portion 10.

In order to complete the assembly operation, inner sleeve 19 is slipped into frictional engagement with the inner surface of slip sleeve 21. Then slip sleeve 21 and inner sleeve 19 are slipped over into enveloping relationship with locking sleeve 9 whereby collar 20 of inner sleeve 19 is disposed in a position below snap ring receiving slot 11. The entire assembly is secured in position by inserting snap ring 22 into snap ring receiving slot 11. The weapon 2 is simply inserted into elongated tube 4. Finally securing sleeve 18, being internally threaded, is screwed onto the externally threaded portion 6 of cap 5. The weapon concealment and locking means formed according to this invention then appears essentially as shown in FIG. 3.

According to a feature of this invention, the locking means associated with weapon 2 takes the form of knurl 23 which is integrally formed thereon adjacent handle 3. In addition, circular groove 24 is formed on weapon 2 and is disposed between knurl 23 and handle 3.

Therefore, when pins 14 and 15 are in their locked positions, as shown in FIG. 3, portions thereof are essentially disposed within the interior of locking sleeve 9 and the distance between the inner edges of pins 14 and 15 is less than the outer diameter of knurl 23. Therefore, the difference between the distance between the inner edges of pins 14 and 15 and the outer diameter of knurl 23 is, in effect, the amount of locking surface holding weapon 2 in its locked position.

In its fully closed position, weapon 2 is disposed in elongated tube 4 and knurl 23 is disposed below pins 14 and 15. Pins 14 and 15 are forced into circular groove 24 by means of the upward pressure of spring 16 acting through washer 17 on pins 14 and 15.

When weapon 2 is in the fully locked position, umbrella 1 can be operated in the normal manner by simply pulling on handle 3 thereby causing elongated tube 4 to slide outwardly in telescoping fashion allowing the main umbrella portion to be opened in a conventional manner.

Figure 2:
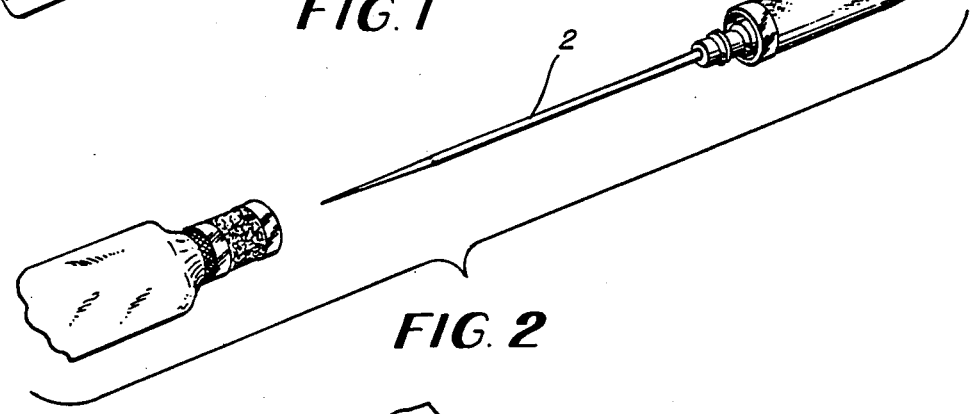
FIG. 2 is a perspective view similar to FIG. 1 in which the weapon is disposed in the withdrawn position.

If it is desired to withdraw weapon 2 from elongated tube 4, initially it is necessary to unscrew securing sleeve 18. Then slip sleeve 21 is depressed downwardly, as shown in FIG. 3, or away from handle 3. This causes the compression of spring 16 by means of collar 20 coming into contact with the upper surface of washer 17. By this means, the pressure of spring 16 forcing pins 14 and 15 into pin receiving slots 12 and 13, respectively, is released thereby allowing pins 14 and 15 to slide out of circular groove 24 and back into pin receiving slots 12 and 13 an amount sufficient to allow knurl 23 to move in an upward direction as viewed in FIG. 3. By this means, weapon 2 can be fully withdrawn, as shown in FIG. 2.

In order to return weapon 2 to its concealed and locked position, it is simply necessary to insert weapon 2 into elongated tube 4 into a position whereby pins 14 and 15 are forced into circular groove 24.

According to another feature of this invention, means is provided to prevent weapon 2 from interferring with umbrella spring catch 25. Spring catch 25 is provided with finger tab 26 which, in turn, is adapted to extend into corresponding apertures formed in the conventional umbrella telescoping elements which comprise elongated tube 4. Since it is likely that weapon 2 would come into contact with spring catch 25 upon insertion into elongated tube 4, guide 8 is elongated and bent to a slight degree and effectively directs the end of weapon 2 around spring catch 25. In addition, guide 8 is bent to a slight degree in order to provide frictional contact with the weapon 2.

INDUSTRIAL APPLICABILITY

By this invention, weapon concealment and locking means is provided whereby a weapon can be effectively concealed and locked in an everyday implement such as an umbrella and whereby the umbrella or the like can be utilized in a conventional manner. In addition, the weapon can be withdrawn, as desired, in a quick, efficient and safe manner.

We claim:

1. Weapon concealment and locking means comprising an elongated tube, a weapon disposed in said elongated tube a ferrule affixed to one end of said elongated tube, said ferrule comprising a first locking means, said first locking means being spring biased and comprising at least one pin receiving slot formed in said ferrule, said spring biased locking means further comprising a pin disposed in said slot, an abutment surface formed on said ferrule and being spaced from said slot and disposed perpendicular to the axis of said elongated tube, a spring disposed in enveloping relationship around said ferrule and between said abutment surface and said pin, a washer disposed between said pin and the adjacent end of said spring, a sleeve coaxially disposed with respect to said elongated tube and in substantially enveloping relationship with respect to said ferrule and said spring, a collar formed on the upper edge of said sleeve and extending inwardly therefrom, the lower surface of said collar being in face contacting relation with respect to the upper surface of said washer during compression of said spring, and a second locking means being formed on said weapon and being adapted to cooperate with said first locking means for releasably retaining said weapon within said elongated tube.

2. Weapon concealment and locking means according to claim 1 wherein said second locking means formed on said weapon comprises a knurl.

3. Weapon concealment and locking means according to claim 1 wherein said weapon is a dagger.

4. Weapon concealment and locking means according to claim 1 wherein said pin receiving slot is disposed at an acute angle with respect to the axis of said elongated tube.

5. Weapon concealment and locking means according to claim 4 wherein said ferrule is hollow and a portion of one of said pin receiving slots defines an opening into said hollow interior of said ferrule.

6. Weapon concealment and locking means according to claim 1 wherein said ferrule comprises an elongated guide disposed in frictional engagement with the weapon.

7. Weapon concealment and locking means according to claim 6 wherein said elongated guide is slightly bent.

8. Weapon concealment and locking means according to claim 1 wherein a slip sleeve is coaxially disposed with respect to said elongated tube and in enveloping frictional relationship with respect to said sleeve.

* * * * *